US008031084B2

(12) United States Patent
Rothschild

(10) Patent No.: US 8,031,084 B2
(45) Date of Patent: Oct. 4, 2011

(54) METHOD AND SYSTEM FOR INFRACTION DETECTION BASED ON VEHICLE TRAFFIC FLOW DATA

(75) Inventor: Leigh M. Rothschild, Sunny Isles Beach, FL (US)

(73) Assignee: Ariel Inventions, LLC, Sunny Isles Beach, FL (US)

( * ) Notice: Subject to any disclaimer, the term of this patent is extended or adjusted under 35 U.S.C. 154(b) by 0 days.

(21) Appl. No.: 12/907,702

(22) Filed: Oct. 19, 2010

(65) Prior Publication Data

US 2011/0032120 A1 Feb. 10, 2011

Related U.S. Application Data

(63) Continuation-in-part of application No. 12/234,825, filed on Sep. 22, 2008.

(51) Int. Cl.
*G08G 1/01* (2006.01)

(52) U.S. Cl. ..... 340/936; 340/905; 340/937

(58) Field of Classification Search ..... 340/933, 340/995.1, 905, 936, 937; 701/301, 1, 23, 701/20

See application file for complete search history.

(56) References Cited

U.S. PATENT DOCUMENTS

| | | | | |
|---|---|---|---|---|
| 6,442,474 | B1 * | 8/2002 | Trajkovic et al. | 701/117 |
| 6,985,827 | B2 * | 1/2006 | Williams et al. | 702/142 |
| 2005/0248469 | A1 * | 11/2005 | DeKock et al. | 340/905 |

* cited by examiner

*Primary Examiner* — Anh V La

(74) *Attorney, Agent, or Firm* — Christopher & Weisberg, P.A.

(57) ABSTRACT

Embodiments of the present invention provide a method, system and computer program product for vehicle speed acquisition and citation. In accordance with an embodiment of the present invention, multiple different imaging systems can be placed individually at different locations along a route of travel, such as a highway, byway or waterway. Images of different vehicles can be captured at each of the locations and different ones of the different vehicles can be image-recognized. A time of travel between pairs of the locations can be determined for selected ones of the different vehicles in order to compute a rate of travel for the selected ones of the different vehicles. A citation signal is generated when a speed of a vehicle exceeds a predetermined speed limit such that the vehicle owner may be automatically cited for speeding.

16 Claims, 5 Drawing Sheets

METHOD AND SYSTEM FOR INFRACTION DETECTION BASED ON VEHICLE TRAFFIC FLOW DATA

CROSS-REFERENCE TO RELATED APPLICATION

This application is a continuation-in-part-of U.S. patent application Ser. No. 12/234,825, filed Sep. 22, 2008, entitled "Vehicle Traffic Flow Data Acquisition and Distribution," the entirety of which is incorporated herein by reference.

STATEMENT REGARDING FEDERALLY SPONSORED RESEARCH OR DEVELOPMENT n/a

FIELD OF THE INVENTION

The present invention relates to a method and system for traffic management, and in particular to a method and system for detecting and citing vehicle speed violations.

BACKGROUND OF THE INVENTION

The explosion of vehicle usage in the United States more than a half-century ago has brought tremendous benefit to the ordinary citizen. The advent of the interstate highway system now enables individuals to travel great distances at high speeds in short periods of time. The ease of travel afforded by the automobile and interstate highway system, however, is not without consequence. For most Americans, traffic has become a part of life and a daily annoyance. Indeed, the presence and anticipation of traffic affects ordinary citizens every day in planning travel and the timing of meetings with others.

For several decades, broadcast media adopted the responsibility of reporting traffic conditions over the airwaves such that listeners and viewers could more easily plan travel routing. Though traffic reports historically have been provided only at periodic intervals, given enough advance warning, savvy travelers could plan alternate routing responsive to the reporting of a traffic condition present at a portion of a planned route. Notwithstanding, planning an alternate route remained highly dependant on both the timing of the receipt of a traffic condition report and the knowledge of the traveler of an alternative route.

Global positioning system (GPS) technologies afford a tremendous leap forward in respect to onboard vehicle navigation and traffic condition avoidance. GPS technologies now can be found as standard equipment in many vehicles and provide the previously absent guarantee of alternate routing knowledge for drivers. Current GPS technologies further integrate with over-the-air broadcasting of real-time traffic conditions utilizing Internet connectivity so that drivers can correlate traffic conditions in real-time along a proposed route of travel.

Not all traffic conditions reported through broadcast traffic reports reflect a complete standstill of traffic. Rather, in most circumstances, traffic flows in an area of congestion—just not at a high rate of speed. Travelers with advance knowledge of congestion along a planned route make alternate routing decisions based upon the nature of traffic flow. So long as traffic flows at an acceptable speed, albeit not an optimal speed, travelers are less likely to prefer an alternate route. Knowing the rate of speed of traffic in a congested area, however, requires the traveler to rely upon the estimates of real-time broadcast reports over the radio over television resulting from personally observed traffic speeds (typically by helicopter or live camera feed).

In addition to providing accurate information concerning congestion, there is a need to determine when a vehicle is speeding and thereby endangering others. Conventionally, a police officer detecting a speeding motorist waits at the side of the road in a traffic flow area to detect the speed of the vehicle and must then enter the flow of traffic to signal the driver of the speeding vehicle to pull over. This endangers the police officer and endangers other motorists. Further, a police department may have an insufficient number of officers to patrol every highway and road to catch speeding motorists. Therefore, there is a need for ticketing speeding motorists without jeopardizing the safety of police and other motorists, and without requiring the presence of a police officer to actually witness the speeding.

SUMMARY OF THE INVENTION

The present invention advantageously provides a method and system for detecting and reporting a speeding infraction by a vehicle. According to one aspect, a method includes acquiring first imagery of a plurality of vehicles at a first location at a first time. The method includes acquiring second imagery of a plurality of vehicles at a second location at a second time. A first vehicle is identified from the acquired first and second imagery. The speed of the vehicle is determined based on a difference between the first time and the second time and a distance between the first location and the second location. When the speed of the vehicle exceeds a predetermined speed, a citation signal is generated.

According to another aspect, the invention provides an apparatus for determining a vehicle speeding infraction. The apparatus includes a memory to store image data from a plurality of video capture devices spaced a known distance apart. The apparatus includes a processor in communication with the memory. The processor recognizes a vehicle appearing in a first image captured by a first one of the plurality of video capture devices at a first time and appearing in a second image captured by a second one of the plurality of video capture devices at a second time. The processor computes a speed of the vehicle based on the first time, the second time, and the known distance.

According to another aspect, the invention provides a system of determining a speeding violation by a vehicle. The system comprises a first image capture device at a first location and a second image capture device at a second location. The first image capture device has a first processor to perform an image recognition algorithm to detect a vehicle in a first image captured by the first image capture device, and to determine a first time at which the vehicle passes in proximity to the first location. The second image capture device has a second processor to perform an image recognition algorithm to detect a vehicle in a second image captured by the second image capture device, and to determine a second time at which the vehicle passes in proximity to the second location.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
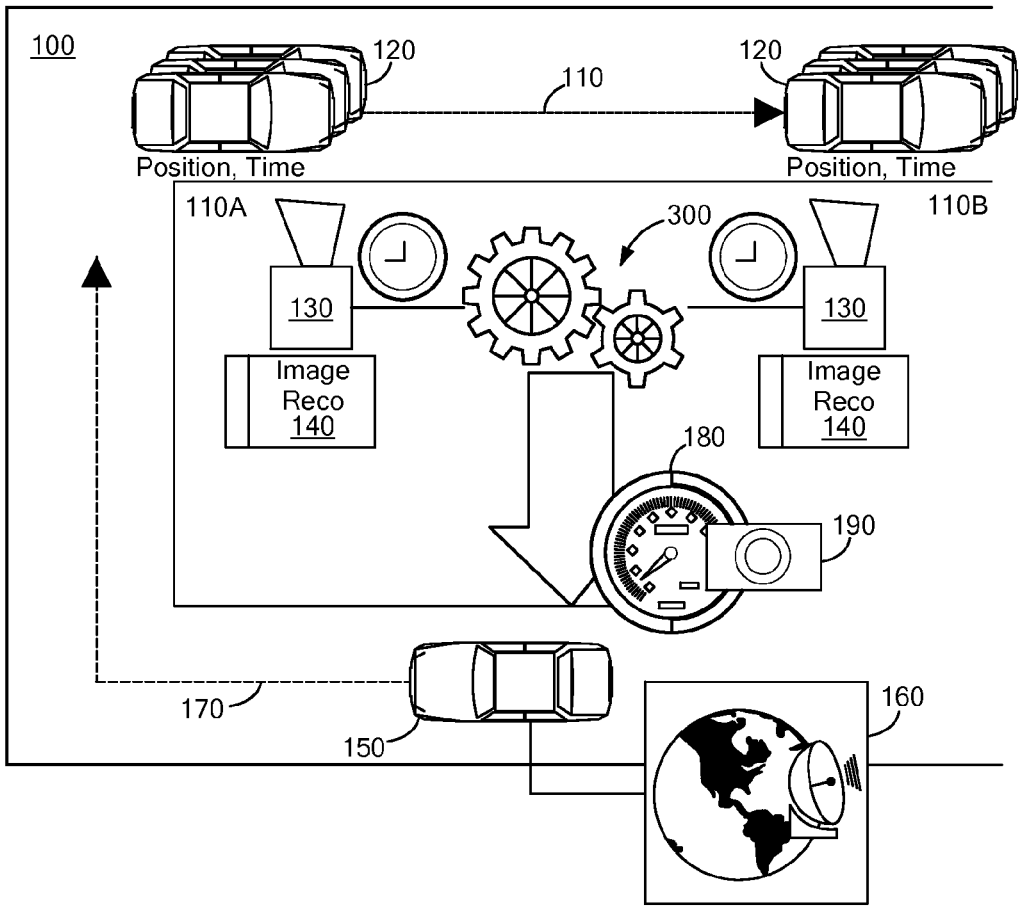
FIG. 1 is a schematic illustration of a process for vehicle traffic flow data acquisition and reporting for onboard vehicle navigation.

Embodiments of the present invention provide a method, system and computer program product for vehicle speed acquisition and citation. In accordance with an embodiment of the present invention, multiple different imaging systems can be placed individually at different locations along a route of travel, such as a highway, byway or waterway. Images of different vehicles can be captured at each of the locations and different ones of the different vehicles can be image-recognized. A time of travel between pairs of the locations can be determined for selected ones of the different vehicles in order to compute a rate of travel for the selected ones of the different vehicles. When a speed of a vehicle exceeds a speed limit, a citation signal is generated, and the vehicle owner may be automatically cited for speeding.

Before describing in detail exemplary embodiments that are in accordance with the present invention, it is noted that the embodiments reside primarily in combinations of apparatus components and processing steps related to implementing a system and method for managing digital images. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

In U.S. patent application Ser. No. 12/234,825, filed Sep. 22, 2008, entitled "Vehicle Traffic Flow Data Acquisition and Distribution," a system and method for identifying traffic congestion are disclosed. The system and method includes capturing a first image of a vehicle at a first location at a first time, capturing a second image of the vehicle at a second location at a second time, and computing a speed of the vehicle between the two locations to determine an amount of congestion. The speed of many vehicles along the route can be determined and averaged to provide an average speed of traffic along the route. The average speed and a captured image can be communicated to an on-board navigation system of a vehicle to notify its driver of the average speed and congestion along a route. As is described herein, this ability to identify a vehicle and determine its speed can be used by law enforcement to detect and cite a speeding violation by the vehicle.

Referring now to the drawing figures in which like reference designators refer to like elements, there is shown in FIG. 1 a block diagram of an exemplary system constructed in accordance with the principles of the present invention. As shown in FIG. 1, imaging systems 130 can be placed at different locations 110A, 110B of a road 100. Imaging systems 130 can acquire imagery of vehicles 120 passing through the location 110A, 110B. The imagery can include individual images, or a collection of images in video imagery. An image recognizer 140 can identify individual ones of the vehicles 120 such that an elapsed time between the identified individual ones of the vehicles 120 in the captured imagery at the different locations 110 can be used to determine a rate of travel (speed) by a processor 300 for each of the identified individual ones of the vehicles 120.

Thereafter, a vehicle 150 projected to travel along a route 170 passing through the locations 110A, 110B can retrieve the rate of travel 180 for multiple different ones of the vehicles 120 in order to identify a degree of congestion between the locations 110A, 110B. Further, imagery 190 of one or more of the locations 110A, 110B can be provided to the vehicle 150. Vehicle 150 could be a police vehicle that receives the identity, location, and speed of a speeding vehicle. Both the rate of travel 180 and the imagery 190 can be provided to the vehicle 150 through an Internet connected onboard navigation system 160. Alternatively, the rate of travel 180 can be provided to a subscriber in the vehicle 150 through text messaging, Web page, or byway of e-mail.or a computer program utilized by the subscriber to display speeding violations. This allows the police office to be safely positioned outside of the traffic area and then allows the police officer in vehicle 150 to find and stop the speeder.

The process described in connection with FIG. 1 can be employed in an onboard vehicle navigation data distribution data processing system. For example, the rate of travel 180 can be provided to the subscriber in the vehicle 150 only when the rate of travel 150 falls above or below a threshold value (essentially an alert to speeding or an unacceptable traffic congestion). In the case where the vehicle 150 is the speeder, the speeder can be alerted of the same and that a citation is going to be issued or that a police officer is en route to issue the citation. Finally, as even yet another alternative, a precise location of the location 110B can be provided to the subscriber in the vehicle 150, for example in terms of latitude and longitude values.

The speed and imagery of a vehicle can also be transmitted to a central monitoring station. Imagery of the vehicle tag number may be used to identify the vehicle. For example, once the vehicle is identified as a speeding vehicle, the tag number, a Vehicle Identification Number (VIN), and the make and model of the vehicle may then be identified. A database may then be employed to determine the vehicle's owner. A citation may then be issued to the owner if it is determined that the vehicle is speeding or is detected committing other traffic violations, such as weaving in and out of lanes recklessly. The citation may be issued to the owner via at least one of email, U.S. mail, wirelessly to an electronic receiver on board the vehicle, and wirelessly to a mobile phone of the owner. The citation may be sent, for example, via text messaging to the owner's mobile phone.

Figure 2:
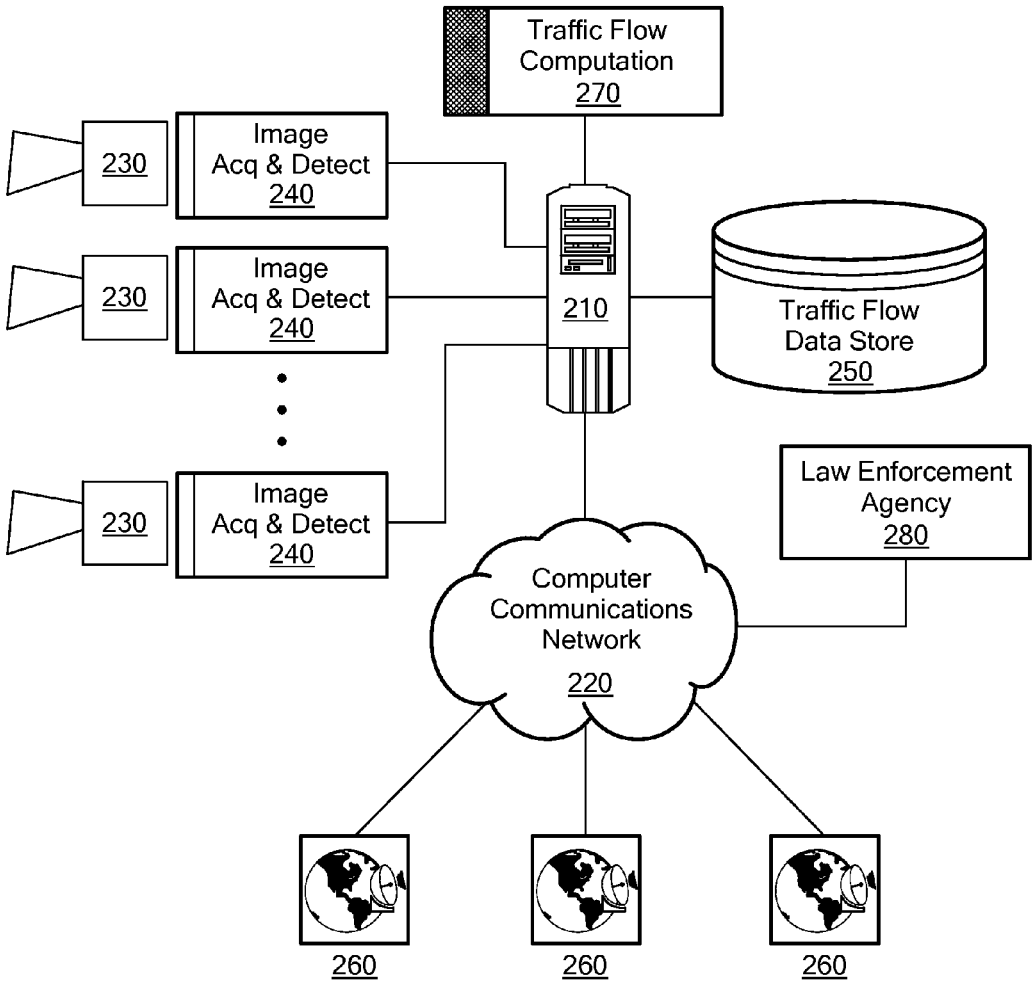
FIG. 2 is a schematic illustration of an onboard vehicle navigation data distribution data processing system configured for vehicle traffic flow data acquisition and reporting.

In further illustration, FIG. 2 schematically depicts an onboard vehicle navigation data and vehicle speeding distribution data processing system configured for vehicle traffic flow data acquisition and reporting. The system can include a host server 210 communicatively coupled to multiple different image acquisition systems 230, each including an image acquisition and detection system 240. The host server 210 can host the execution of traffic flow and speeding computation logic 270. The traffic flow computation logic 270 can include program code enabled to compute a rate of travel for different vehicles at a location based upon duration of travel between pairs of the image acquisition systems 230 and determine whether to issue a citation signal based upon a determination that speeding has occurred. The program code further can be enabled to store the rate of travel in connection with each vehicle and a corresponding location within coupled traffic flow data store 250. The server 210 and the data store 250 may be accessed by a law enforcement agency 280 via the communications network 220 and the citation signal may be generated and sent to a law enforcement agency 280 by the host server 210.

Multiple different Internet connected onboard navigation systems 260 can be communicatively coupled to the host server 210 over computer communications network 220. Consequently, rates of travel for relevant locations along a planned route in the different ones of the onboard navigation systems 260 can be provided to end users through respective ones of the onboard navigation systems 260. Further, imagery of locations along a planned route in the different ones of the onboard navigation systems 260 can be provided to end users through respective ones of the onboard navigation systems 260. The imagery can be provided at the request of an end user through the selection of an icon in a user interface in a corresponding one of the onboard navigation systems 260 at the location along the planned route. Yet further, current weather conditions acquired for the relevant locations along a planned route can be provided to the different ones of the onboard navigations systems 260.

One embodiment is a system for determining a speeding violation by a vehicle. In this embodiment, the onboard navigation system 260 can be a system in the police officer's vehicle that receives the citation signal from the host server 210. A first image capture device 230 has a first processor 240 to perform an image recognition algorithm to detect a vehicle in a first image captured by the first image capture device 230. A second capture device 230 has a second processor 240 to perform an image recognition algorithm to detect the vehicle in a second image captured by the second image capture device 230. The time of image capture can be communicated to a central processor 210 that computes a speed of a vehicle using traffic flow computation software 270, based on the times of first and second image capture and a known distance between the first and second image capture devices. The traffic flow data store 250 can be used to store speed limit data such that a comparison can be made by the server 210 between calculated vehicle speed and the speed limit between the image acquisition systems 230 acquiring the imagery. The traffic flow data store 250 can also store citation fine data and be used by server 210 to provide this information to a law enforcement agency 280 or to the police officer via the onboard navigation system 260 in the vehicle 150.

Thus, in one embodiment, image recognition is performed by a processor at an image capture device. Alternatively, the images captured by image capture devices may be transmitted to a central processor that performs image recognition on the various images captured by the image capture devices. Image recognition may be achieved by applying an image recognition algorithm to a first image to produce a first result, applying the image recognition algorithm to a second image to produce a second result, and by comparing the first and second results to determine if the same vehicle is in both images. The central processor may also compute a speed of a vehicle and generate a citation signal when the speed of the vehicle exceeds a speed limit. The citation signal may be a data signal that includes the speed of the vehicle and/or the difference between the vehicle speed and the posted speed limit. The image recognition algorithm may further detect a license tag or VIN of a vehicle and a make and model of a vehicle.

When the speed limit is exceeded, the speed of the vehicle can be transmitted to a law enforcement agency or officer. An image of the vehicle may also be transmitted to the law enforcement agency or officer. In one embodiment, a police officer may be able to remotely control a camera 230 that captures the image of the vehicles passing by. In some embodiments, the speed of the vehicle may be determined by the camera 230 or by a separate processor, e.g., server 210. The speed of the vehicle and the amount of the traffic fine for speeding may also be transmitted to an on-board navigation system of the speeding vehicle, or otherwise transmitted to the operator of the vehicle. In one embodiment, the processor 210 may automatically issue a paper citation to an owner of the vehicle. The owner of the vehicle may be identified by identifying a license tag number on the vehicle and correlating the tag number with the owner as recorded in a motor vehicle department database.

Figure 3A:
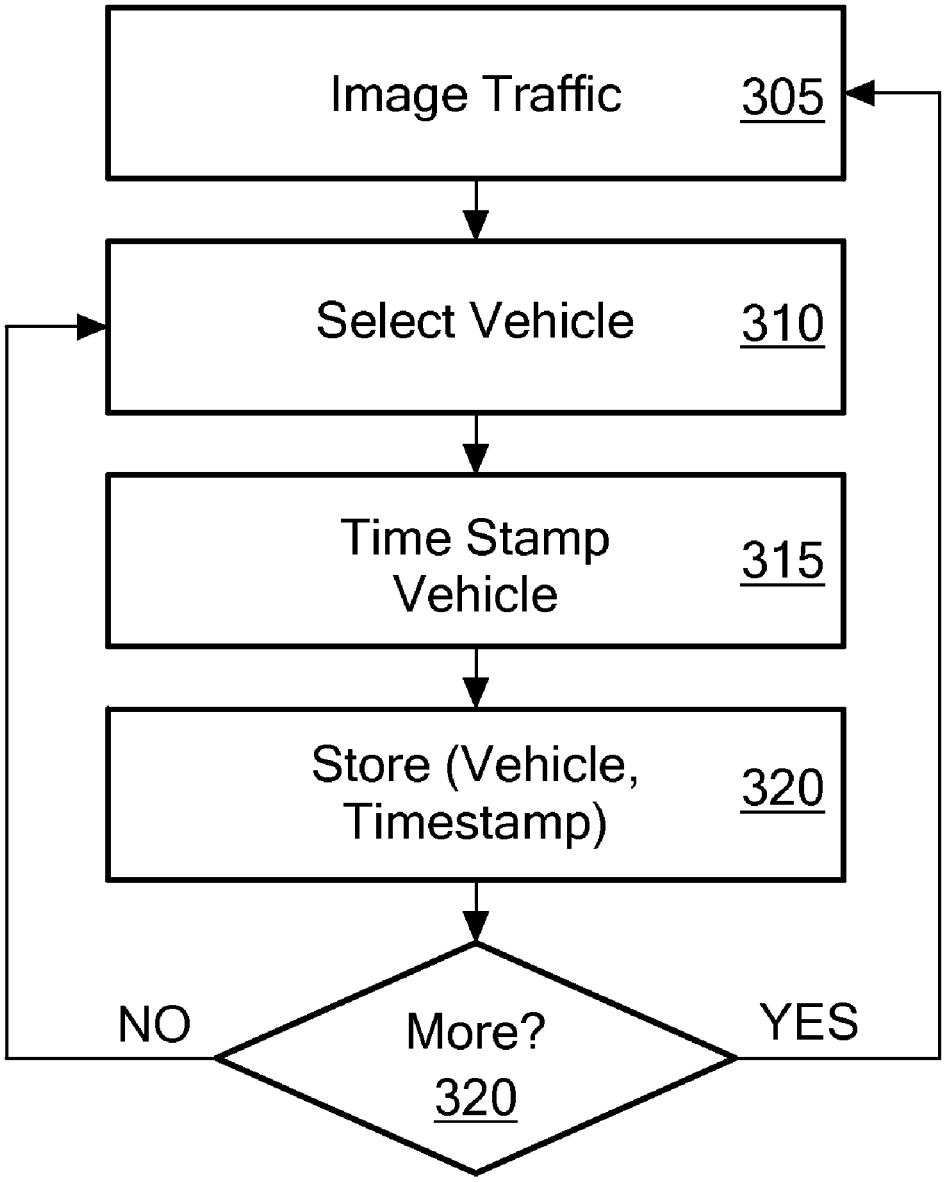
FIGS. 3A and 3B, taken together, are a flow chart illustrating a process for vehicle traffic flow data acquisition and reporting for onboard vehicle navigation.
Figure 3B:
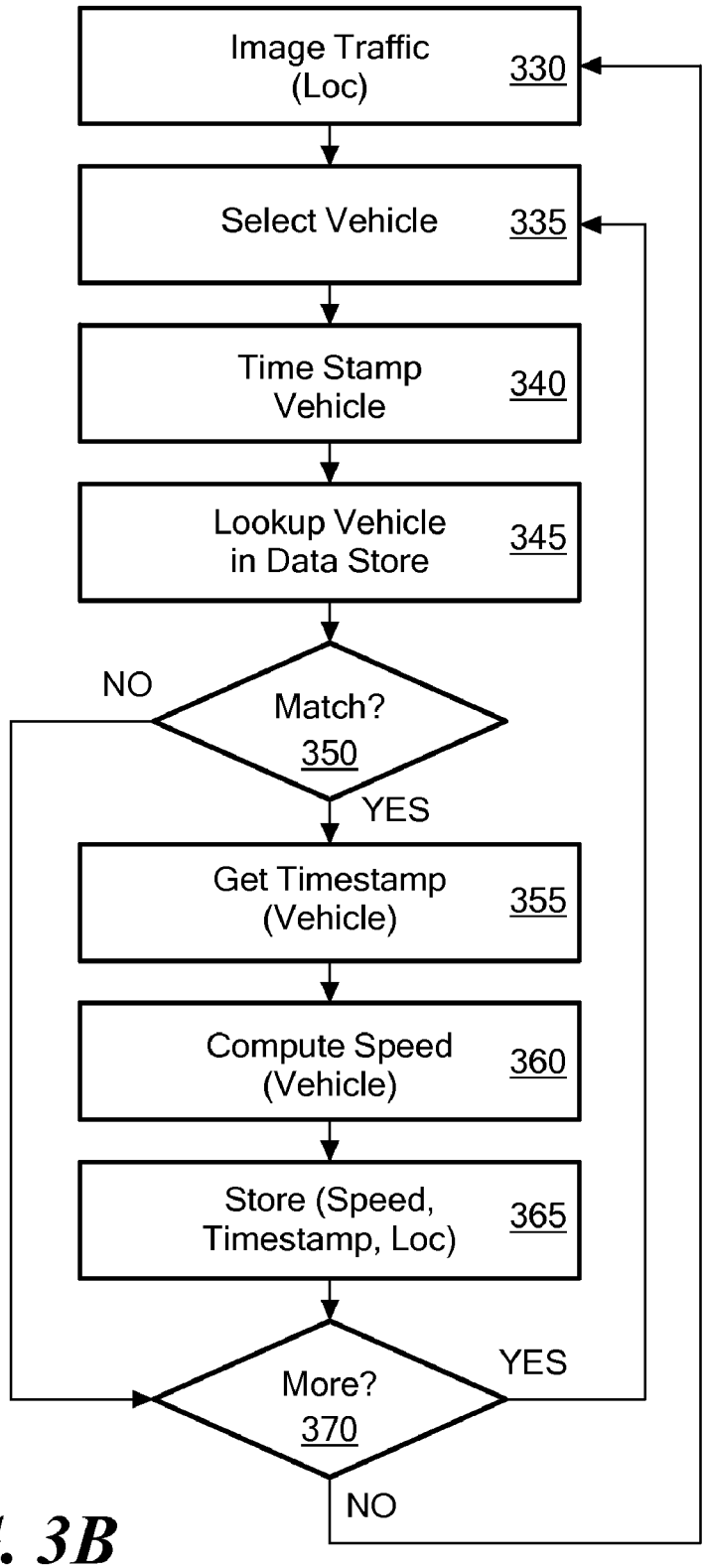

In yet further illustration of the operation of the traffic flow computation logic 270, FIGS. 3A and 3B, taken together, are a flow chart illustrating a process for vehicle traffic flow data acquisition and reporting for onboard vehicle navigation. Beginning in block 305 of FIG. 3A, traffic can be imaged at a first point in a route along a roadway. In block 310, a first vehicle in the image can be selected and time stamped in block 315 to record a time of acquiring the image. In block 320, the time stamp can be stored in connection with the selected vehicle and, in decision block 325, if additional vehicles remain to be time stamped in the image, the process can repeat in block 310. Otherwise, a new image can be acquired in block 305 and the process can continue as before through block 310.

Turning now to FIG. 3B, in block 330 traffic can be imaged at a subsequent point in the route along the roadway. In block 335, a first vehicle in the image can be selected and time stamped in block 340 to record a time of acquiring the image. In block 345, the vehicle can be compared to a data store of vehicles to determine whether a time stamp had been previously recorded for the vehicle at the first point in the route. In decision block 350, if a match is found, in block 355 the previously stored time stamp for the vehicle can be retrieved and in block 360 a rate of travel can be computed for the vehicle based upon the known distance between the points in the route and the duration of time taken by the vehicle to travel between the points according to the stored time stamp and the time stamp applied in block 340.

Thereafter, in block 365 the rate of travel can be recorded in connection with the subsequent point in the route and the time of acquiring the image at the subsequent point in the route. In decision block 370, if rates of travel for additional vehicles remain to be computed, the process can repeat in block 335 with the selection of a next vehicle in the image. Otherwise, a new image can be acquired at the subsequent point in the route in block 330.

Of note, by acquiring a multitude of rates of travel for the subsequent point in the route, an average rate of travel can be computed for the subsequent point in the route for a given range of time or for a given moment in time. The average rate of travel can be communicated to inquiring vehicles anticipating travel through the subsequent point in the route along with relevant imagery of the subsequent point in the route. Consequently, an accurate characterization of congestion for a location in a route of travel can be communicated in real time to inquiring travelers through an Internet connected onboard navigation system.

Figure 4:
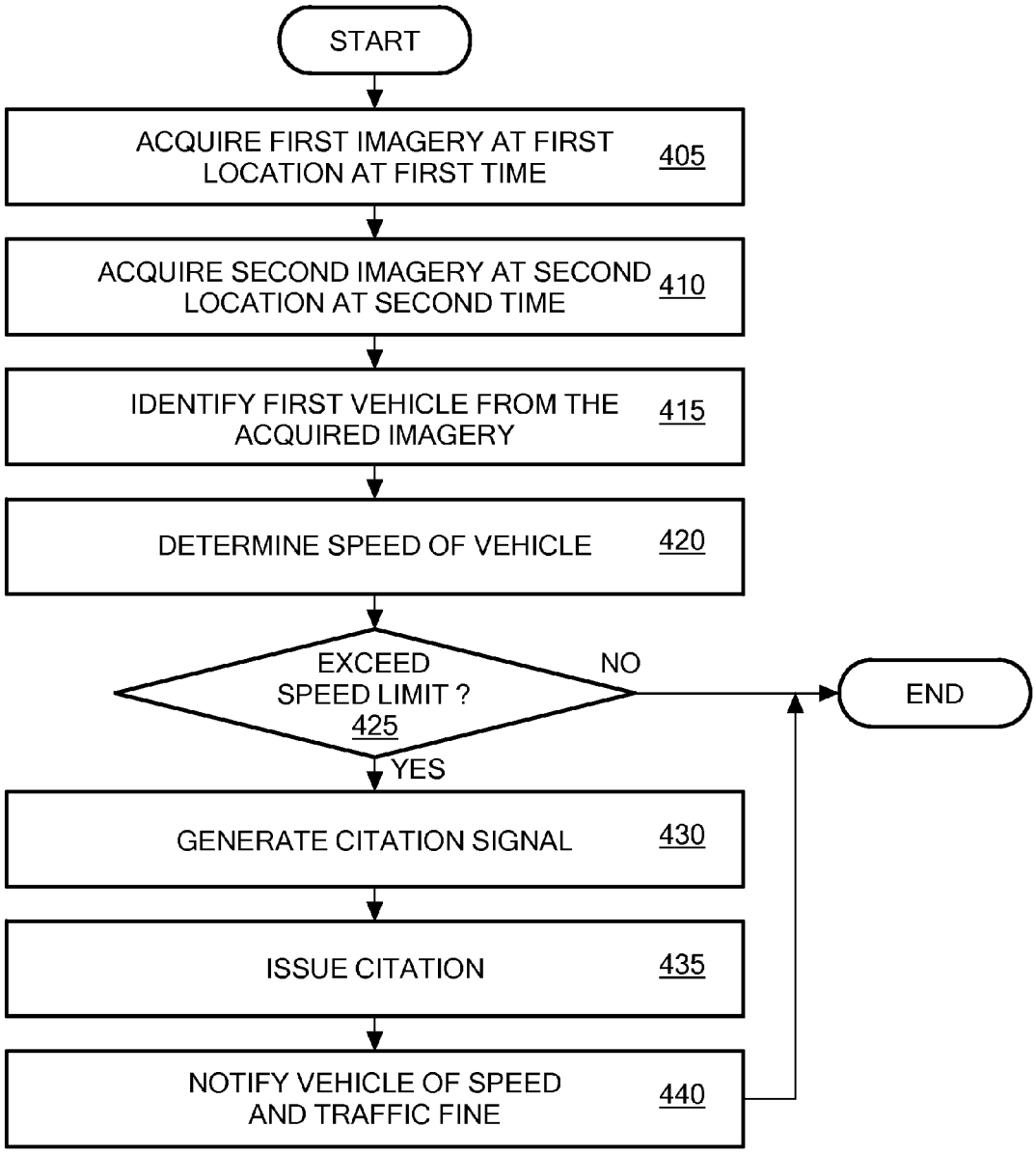
FIG. 4 is a flow chart of an exemplary process for vehicle traffic speed violation detection and citation in accordance with the principles of the present invention.

FIG. 4 is a flow chart of an exemplary process for vehicle traffic speed violation detection and citation in accordance with the principles of the present invention. In block 405, a first image is acquired at a first location at a first time. At block 410, a second image is acquired at a second location at a second time. At block 415, an identity of a vehicle appearing in both the first and second images is acquired. The speed of the vehicle is determined at block 420. The speed can be determined from the ratio of the distance between the first and second location and the difference between the first time and the second time. At block 425, the system determines if the speed limit has been exceeded by the identified vehicle. If not, the process ends. If the speed limit has been exceeded, a citation signal is generated at block 430. The citation signal may also include the speed of the vehicle, the vehicle's tag number, the vehicle's location and an image of the vehicle. A paper citation may automatically be issued at block 435 or a police officer alerted. Further, the speed and amount of the fine for speeding may be communicated to the vehicle at block 440.

Embodiments of the invention can take the form of an entirely hardware embodiment, an entirely software embodiment or an embodiment containing both hardware and software elements. In a preferred embodiment, the invention is implemented in software, which includes but is not limited to firmware, resident software, microcode, and the like. Furthermore, the invention can take the form of a computer program product accessible from a computer-usable or computer-readable medium providing program code for use by or in connection with a computer or any instruction execution system.

For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device). Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution. Input/output or I/O devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A method of infraction detection based on vehicle traffic flow data, the method comprising:

acquiring first imagery of a plurality of vehicles at a first location at a first time;

acquiring second imagery of a plurality of vehicles at a second location at a second time;

identifying a first vehicle from the acquired first imagery and the acquired second imagery;

determining a speed of the first vehicle;

generating a citation signal when the speed of the first vehicle exceeds a predetermined speed; and attempting to transmit the citation signal to a device of a person associated with the vehicle.

2. The method of claim 1, wherein the citation signal is communicated to a law enforcement agency.

3. The method of claim 2, wherein at least a portion of at least one of the acquired first and second imagery is communicated to the law enforcement agency.

4. The method of claim 1, wherein the citation signal includes a license tag of the first vehicle and a location of the vehicle.

5. The method of claim 1, wherein the speed of the vehicle is determined based on a difference between the first time and the second time and a distance between the first location and the second location.

6. The method of claim 5, wherein the citation signal includes a difference between the speed of the first vehicle and the predetermined speed.

7. The method of claim 1, wherein the device is a mobile phone of the person associated with the vehicle.

8. An apparatus for determining a vehicle speeding infraction, the system comprising:

memory to store image data from a plurality of video capture devices spaced a known distance apart; and a processor in communication with the memory, the processor;

recognizing a vehicle appearing in a first image captured by a first one of the plurality of video capture devices at a first time and appearing in a second image captured by a second one of the plurality of video capture devices at a second time;

computing a speed of the recognized vehicle based on the first time, the second time, and the known distance;

generating a citation signal when the computed speed exceeds a predetermined speed; and attempting to communicate the citation signal to a device of a person associated with the vehicle.

9. The apparatus of claim 8, wherein the citation signal includes the speed, location, and identity of the vehicle.

10. The apparatus of claim 9, wherein the citation signal and the second image is transmitted to a law enforcement agency.

11. The apparatus of claim 8, wherein recognizing the vehicle comprises:

applying an image recognition algorithm to the first image to produce a first result;

applying the image recognition algorithm to the second image to produce a second result; and comparing the first and second results.

12. The apparatus of claim 11, wherein the image recognition algorithm detects a make and model of the vehicle.

13. The apparatus of claim 12, wherein the image recognition algorithm detects at least one of a license tag number of the vehicle, and a Vehicle Identification Number (VIN) of the vehicle.

14. The apparatus of claim 8, wherein the device is an on board navigation system of the vehicle.

15. A system of determining a speeding violation by a vehicle, the system comprising:

a first image capture device at a first location, having a first processor to perform an image recognition algorithm to detect the vehicle in a first image captured by the first image capture device and to determine a first time at which the vehicle passes in proximity to the first location;

a second image capture device at a second location having a second processor to perform an image recognition algorithm to detect the vehicle in a second image captured by the second image capture device and to determine a second time at which the vehicle passes in proximity to the second location; and a third processor to:

compute a speed of the vehicle based on a known distance between the images captured by the first and second image capture devices and based on the first and second times;

generate a citation signal when the speed of the vehicle exceeds a predetermined speed; and attempting to transmit the citation signal to a device of a person associated with the vehicle.

16. The system of claim 15, further comprising a third processor to:

receive an image of the vehicle from at least one of the first and second processor;

compute a speed of the vehicle; and communicate the image of the vehicle and the speed of the vehicle to a law enforcement officer.

* * * * *